US008056183B2

(12) United States Patent
Shoemaker et al.

(10) Patent No.: US 8,056,183 B2
(45) Date of Patent: Nov. 15, 2011

(54) MULTIPLE POSITION BALL STUD FOR CLOSURE STRUT

(75) Inventors: James H. Shoemaker, White Lake, MI (US); Mark W. Ruesink, Grand Blanc, MI (US); Hitesh R. Desai, Rochester, MI (US); Andrew G. Fox, Farmington Hills, MI (US); Scott W. Thorpe, Milford, MI (US); Paul R. Meernik, Redford, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 624 days.

(21) Appl. No.: 12/028,076

(22) Filed: Feb. 8, 2008

(65) Prior Publication Data

US 2009/0202292 A1 Aug. 13, 2009

(51) Int. Cl.
*E05F 3/14* (2006.01)

(52) U.S. Cl. ..... 16/58; 296/146.8

(58) Field of Classification Search ..... 16/58, 49, 16/66, 84, 82, 71, DIG. 9, DIG. 17, DIG. 21; 296/193.11, 76, 146.8; 180/69.21; 403/131, 403/142, 122

See application file for complete search history.

(56) References Cited

U.S. PATENT DOCUMENTS

| | | | | |
|---|---|---|---|---|
| 4,854,554 | A * | 8/1989 | Ludwig | 267/64.11 |
| 4,966,403 | A * | 10/1990 | Nordstrom | 296/76 |
| 4,973,097 | A * | 11/1990 | Hosan et al. | 296/76 |
| 6,182,952 | B1 | 2/2001 | Gutierrez | |
| 6,254,114 | B1 * | 7/2001 | Pulling et al. | 280/93.511 |
| 6,298,604 | B1 * | 10/2001 | Rogers et al. | 49/340 |
| 6,394,211 | B1 * | 5/2002 | Palenchar et al. | 180/69.21 |
| 6,637,531 | B2 * | 10/2003 | Palenchar et al. | 180/69.21 |
| 6,698,963 | B1 * | 3/2004 | Parker et al. | 403/130 |
| 7,387,181 | B2 * | 6/2008 | Adoline et al. | 180/69.21 |

FOREIGN PATENT DOCUMENTS

| | | |
|---|---|---|
| DE | 19641428 C1 | 2/1998 |
| DE | 19758130 A1 | 9/1998 |

* cited by examiner

*Primary Examiner* — William L. Miller

(57) ABSTRACT

A multiple position ball stud assembly for a closure strut supporting a closure pivotally attached adjacent to an opening, and a method of operation, is disclosed. The ball stud assembly may comprise a ball stud and a ball stud actuator. The ball stud may have a socket portion mounted on a closure lift assist strut and a guide pin extending from the socket portion. The ball stud actuator assembly may include a housing, a guide for receiving the guide pin, and an actuator for moving the guide pin along the guide to thereby cause the ball stud to move relative to the housing. The multiple position ball stud assembly may also include a control assembly that engages the actuator for selectively causing the actuator to move the guide pin along the guide.

19 Claims, 2 Drawing Sheets

MULTIPLE POSITION BALL STUD FOR CLOSURE STRUT

BACKGROUND OF INVENTION

The present invention relates generally to closures employing closure lift assist struts to maintain closures in open positions, and assist with opening and closing of the closures.

Rear closure assemblies (e.g., hatches, deck lids, lift gates, and lift glass) for vehicles often have pressurized gas struts that assist in pivoting the closure into its open position, as well as holding it open to allow for accessing of the rear compartment. The pressures of the piston and cylinder assemblies, as well as the mounting location of the ball joints on each end of these struts must be designed to balance opening efforts and hold open force with closing efforts, often compromising all three. This is particularly difficult given the temperature ranges in which the struts must operate, and over the long life of the vehicle.

SUMMARY OF INVENTION

An embodiment contemplates a multiple position ball stud assembly for a closure strut supporting a closure pivotally attached adjacent to an opening. The ball stud assembly may comprise a ball stud having a socket portion configured for mounting on a closure lift assist strut and a guide pin extending from the socket portion; and a ball stud actuator assembly including a housing, a guide for receiving the guide pin, and an actuator configured to selectively move the guide pin along the guide to thereby cause the ball stud to move relative to the housing.

An embodiment contemplates a closure assembly for pivotally closing over an opening in a vehicle including a closure pivotally attached relative to the vehicle, and a closure lift assist strut pivotally mounted to the closure at a first end. The closure assembly may also include a ball stud having a socket portion mounted on the closure lift assist strut on a second, opposed end and a guide pin extending from the socket portion; a ball stud actuator assembly including a housing, a guide for receiving the guide pin, and an actuator configured to selectively move the guide pin along the guide to thereby cause the ball stud to move relative to the housing; and a control assembly operatively engaging the actuator for selectively causing the actuator to move the guide pin along the guide.

An embodiment contemplates a method of varying a ball stud position of a lift assist strut employed to support a closure pivotally attached adjacent to an opening, the method comprising the steps of: moving the ball stud to an opening position on a ball stud actuator assembly prior to lifting the closure from a closed position; and moving the ball stud to a closing position on the ball stud actuator assembly prior to moving the closure from the fully open position to the closed position.

An advantage of an embodiment is that a multiple position ball stud for a closure strut allows the strut position and strut pressure to be better optimized for closure opening events and closure closing events. This allows for lower closure efforts, while improving lift efforts and hold open performance versus conventional lift assist strut attachments. The multiple position ball stud may also allow for less deflection of the closure due to strut loads.

DETAILED DESCRIPTION

Figure 1:
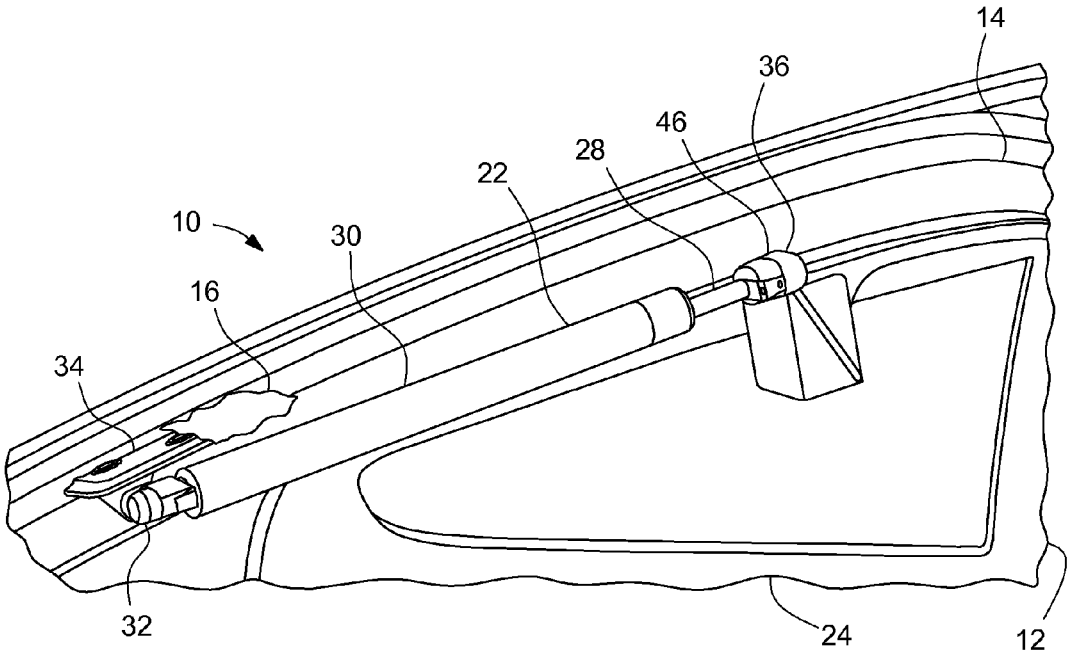
FIG. 1 is a schematic, perspective view of a left, rear portion of a vehicle, with a lift assist strut in a closure closed position and a ball stud in a closing position.
Figure 2:
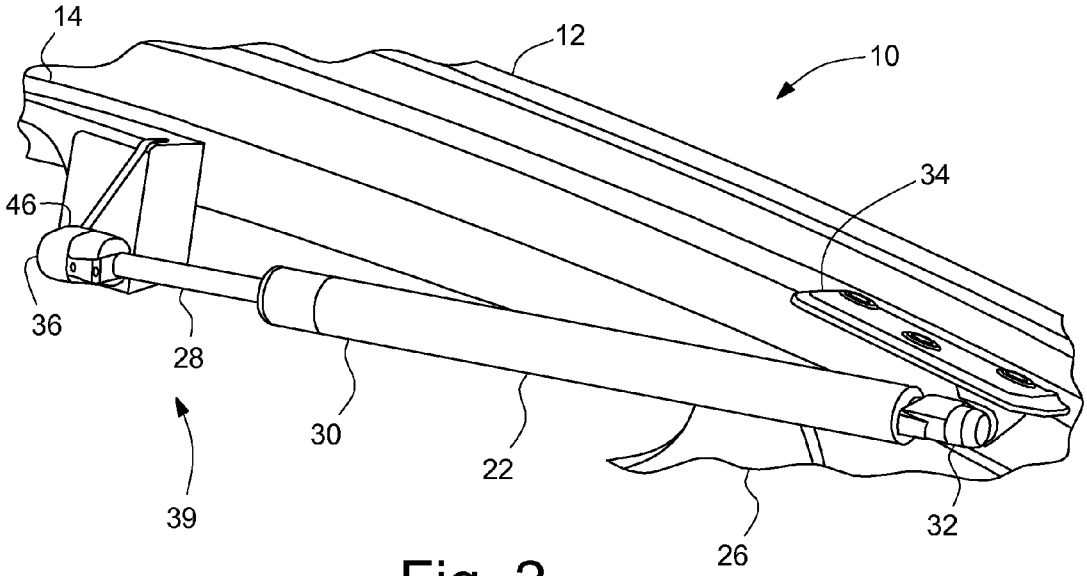
FIG. 2 is a schematic, perspective view of a right, rear portion of the vehicle, with the lift assist strut in a closure closed position and the ball stud in an opening position.
Figure 3:
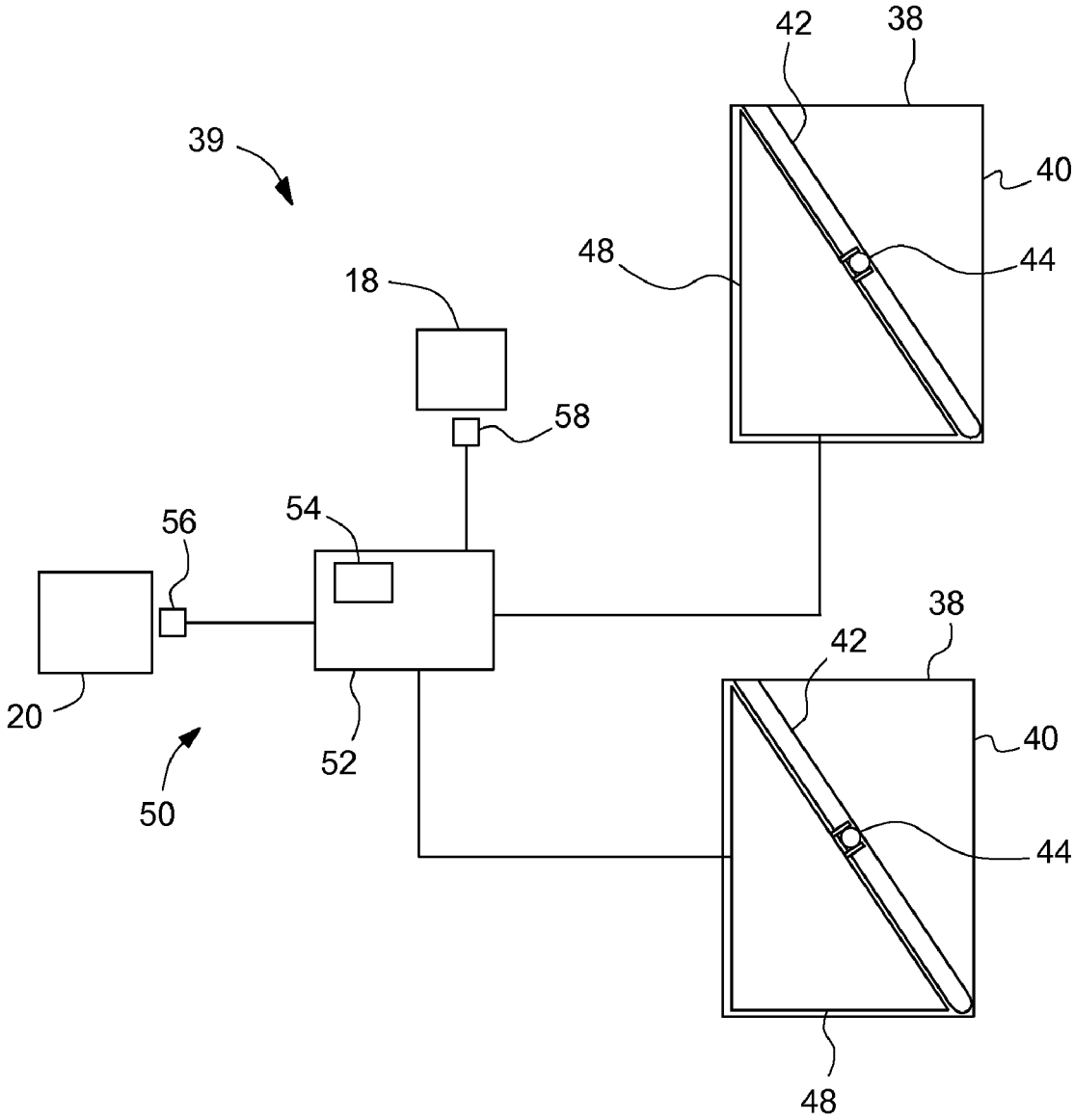
FIG. 3 is a schematic view of a portion of a ball stud position adjustment assembly.

Referring to FIGS. 1-3, a vehicle, indicated generally at 10, is shown. The vehicle 10 includes a body 12 having an opening 14 between a left side 24 and a right side 26 of the body 12. A closure 16, which may be a hatch, deck lid, lift gate, or lift glass, pivotally attaches to the body 12 (or in the case of lift glass to a larger closure on the body) via hinges 18. The closure 16 may be selectively pivoted between a closed position where the closure 16 is held in the closed position by a latch 20 and a fully open position, where a pair of closure lift assist struts 22 hold the closure 16 in this fully open position. Alternatively, the particular closure 16 may include only a single closure lift strut, if so desired.

The lift assist struts 22 each include a piston 28 telescopically mounted in a cylinder 30. Each cylinder 30 is connected to a respective closure ball stud 32, which is, in turn, connected to a closure attachment bracket 34. The closure attachment brackets 34 are mounted to the closure 16. Each piston 28 is connected to a respective bodyside ball stud 36, which, in turn, is connected to a ball stud actuator assembly 38—part of a ball stud position adjuster assembly 39. One ball stud actuator assembly 38 is mounted to the left side 24 of the body 12, and the other ball stud actuator assembly 38 is mounted to the right side 26 of the body 12.

Each ball stud actuator assembly 38 includes an actuator housing 40 and a guide 42. Each bodyside ball stud 36 includes a socket 46 mounted to its corresponding piston 28 and a guide pin 44 extending from and pivotable relative to the socket 46. Each of the guide pins 44 mounts in and is guided by its respective guide 42. The pins 44 may be any suitable shape for moving along the guides 42. Thus, the path that each bodyside ball stud 36 can move relative to the body 12 is defined by its respective guide 42. An actuator 48 is located in each actuator housing 40 and moves its respective guide pin 44 between different positions in the guides 42. The actuators 48 may be, for example, a gear system and electric motor. Although, other types of actuators may be employed, if so desired.

The actuators 48 are connected to a control assembly 50. The control assembly 50 may include a microprocessor 52, having a timer 54, connected to and controlling the motion of the actuators 48. The control assembly 50 may also include a latch release sensor 56 that detects when the closure latch 20 is latched and unlatched. Alternatively, the latch release sensor 56 may be a closure ajar sensor that distinguishes between a fully closed closure position and partially or fully open closure positions. In addition, the control assembly 50 may include a closure full open sensor 58 located adjacent to one of the hinges 18 for detecting when the closure 16 is in its full open position.

The operation of the closure components as the closure 16 is moved between its closed and fully open position will now be discussed. While the closure 16 is in a closed state, with the latch 20 holding it closed, the actuator 48 maintains the bodyside ball studs 36 in their higher positions (shown in FIG. 1). This position may tend to place the least amount of stress into the closure 16 while in the closed position. When the latch 20 is released, the latch release sensor 56 (or closure ajar sensor) communicates this to the microprocessor 52. Upon unlatching, the microprocessor 52 causes the actuator 48 to move the bodyside ball stud 36 to its lower position (shown in FIG. 2). This creates a force that biases the closure 16 upward toward its open position. As an alternative, the actuator 48 may move the bodyside ball studs 36 to their lower positions at a closure latching event, indicated by the latch release sensor 56 detecting a latch closing during the previous closure closing event.

The force from the closure lift assist struts 22 then lifts the closure 16 to its fully open position, with little or no lift provided by the person opening the closure 16. As the closure 16 is lifted to its fully open position, the bodyside ball studs 36 remain in their lower positions. The lower bodyside ball stud positions provide more lift assist (i.e., net force at a closure handle location) during the opening event than if they were in the higher positions. Once the closure 16 is in the fully open position, as detected by the closure full open sensor 58, the microprocessor 52 then causes the actuators 48 to move the bodyside ball studs 36 to their higher positions. The force from the closure lift assist struts 22 is sufficient to hold the closure 16 in its fully open position. The bodyside ball studs 36 are then ready for a closure closing event since the higher positions will reduce the effort required by the person to pull the closure 16 closed. As an alternative, the control of the movement of the actuators 48 back to the higher position could be based on the timer 54. For this alternative, the timer is set for a predetermined time that estimates a free rise time of the closure 16, which may be predetermined based on the characteristics of a worn strut in cold temperatures. For another alternative, the bodyside ball studs 36 may move to their higher positions as the closure 16 is moving toward its fully open position rather than moving after reaching the fully open position.

As a person pulls the closure 16 toward the closed position, the bodyside ball studs 36 remain in the higher positions. The higher positions reduce the closing efforts versus the lower positions, thus reducing the effort for the person closing the closure 16 and allowing for ease of latching the closure 16 when reaching its closed position.

While the embodiment discussed above shows the multiple position ball stud assemblies on the body side of the closure lift assist struts, for some vehicle/closure configurations, it may be more advantageous to reverse them. That is, mount the multiple position ball stud assemblies on the closure side of the lift assist struts. Vehicles where this alternative configuration may be particularly useful are those where the closure tends to be in a vertical position when closed, such as, for example, a minivan rear lift gate. Accordingly, when referring to the multiple position ball stud assemblies, this includes both body-side and closure-side mounted assemblies.

While certain embodiments of the present invention have been described in detail, those familiar with the art to which this invention relates will recognize various alternative designs and embodiments for practicing the invention as defined by the following claims.

What is claimed is:

1. A multiple position ball stud assembly for a closure strut supporting a closure pivotally attached adjacent to an opening, the ball stud assembly comprising:

a ball stud having a socket portion configured for mounting on a closure lift assist strut and a guide pin extending from the socket portion;

a ball stud actuator assembly including a housing, a guide for receiving the guide pin, and an actuator configured to selectively move the guide pin along the guide to thereby cause the ball stud to move relative to the housing; and a control assembly operatively engaging the actuator for selectively causing the actuator to move the guide pin along the guide, wherein the control assembly includes a processor, a latch release sensor operatively engaging the processor and configured to detect when a latch is actuated, and a closure full open sensor configured to detect when the closure is in a fully open position.

2. The ball stud assembly of claim 1 wherein the processor includes a timer.

3. The ball stud assembly of claim 1 wherein the ball stud actuator includes a high ball stud position configured for desired closure closing forces and a low ball stud position configured for desired closure opening forces.

4. The ball stud assembly of claim 1 wherein the housing is configured to mount to a vehicle body.

5. The ball stud assembly of claim 1 including a second ball stud having a second socket portion configured for mounting on a second closure lift assist strut and a second guide pin extending from the second socket portion; and a second ball stud actuator assembly including a second housing, a second guide for receiving the second guide pin, and a second actuator configured to selectively move the second guide pin along the second guide to thereby cause the second ball stud to move relative to the second housing.

6. A closure assembly for pivotally closing over an opening in a vehicle comprising:

a closure pivotally attached relative to the vehicle;

a closure lift assist strut pivotally mounted to the closure at a first end;

a ball stud having a socket portion mounted on the closure lift assist strut on a second, opposed end and a guide pin extending from the socket portion;

a ball stud actuator assembly including a housing, a guide for receiving the guide pin, and an actuator configured to selectively move the guide pin along the guide to thereby cause the ball stud to move relative to the housing; and a control assembly operatively engaging the actuator for selectively causing the actuator to move the guide pin along the guide.

7. The closure assembly of claim 6 including a latch configured to selectively hold the closure in a closed position, and wherein the control assembly includes a processor with a timer and a latch release sensor operatively engaging the processor and configured to detect when the latch is actuated.

8. The closure assembly of claim 6 including a latch configured to selectively hold the closure in a closed position, and wherein the control assembly includes a processor, a latch release sensor operatively engaging the processor and configured to detect when the latch is actuated, and a closure full open sensor configured to detect when the closure is in a fully open position.

9. The closure assembly of claim 6 wherein the ball stud actuator includes a high ball stud position configured for desired closure closing forces and a low ball stud position configured for desired closure opening forces.

10. The closure assembly of claim 6 wherein the housing is configured to mount to a vehicle body.

11. The closure assembly of claim 6 including a second closure lift assist strut pivotally mounted to the closure at a first end; a second ball stud having a second socket portion mounted on a second closure lift assist strut on a second, opposed end and a second guide pin extending from the second socket portion; and a second ball stud actuator assembly including a second housing, a second guide for receiving the second guide pin, and a second actuator configured to selectively move the second guide pin along the second guide to thereby cause the second ball stud to move relative to the second housing, the second actuator operatively engaging the control assembly.

12. The closure assembly of claim 11 wherein the housing is configured to mount to a first side of a vehicle body and the second housing is configured to mount to a second, opposed side of the vehicle body.

13. A method of varying a position of a ball stud of a lift assist strut employed to support a closure pivotally attached adjacent to an opening with the ball stud having a socket portion configured for mounting on the lift assist strut and a guide pin extending from the socket portion, the method comprising the steps of:

(a) moving the ball stud to an opening position on a ball stud actuator assembly prior to lifting the closure from a closed position, the ball stud actuator assembly including a housing, a guide for receiving the guide pin, and a actuator configured to selectively move the guide pin along the guide to thereby cause the ball stud to move relative to the housing; and (b) moving the ball stud to a closing position on the ball stud actuator assembly prior to moving the closure from the fully open position to the closed position.

14. The method of claim 13 wherein step (a) is further defined by moving the ball stud to the opening position upon detecting, with a sensor, an unlatching of a closure latch.

15. The method of claim 13 wherein step (a) is further defined by moving the ball stud to the opening position upon moving the closure to the closed position.

16. The method of claim 13 wherein step (b) is further defined by moving the ball stud to the closing position upon detecting, with a sensor, that the closure is in the fully open position.

17. The method of claim 13 wherein step (b) is further defined by moving, with the actuator, the ball stud to the closing position after a predetermined time has passed from unlatching the closure in the closed position.

18. The method of claim 13 wherein step (a) is further defined by moving the ball stud to the opening position upon detecting, with a sensor, a closure ajar position of the closure.

19. The method of claim 13 wherein step (a) is further defined by sliding a portion of the ball stud along a guide with an actuator in order to move the ball stud to the opening position.

* * * * *